US006923749B1

(12) United States Patent
Smith

(10) Patent No.: US 6,923,749 B1
(45) Date of Patent: Aug. 2, 2005

(54) FULL-BODY ACCORDION-MOTION EXERCISE MACHINE

(76) Inventor: Barry Stewart Smith, 1921 Gates Ave., #B, Redondo Beach, CA (US) 90278

( * ) Notice: Subject to any disclaimer, the term of this patent is extended or adjusted under 35 U.S.C. 154(b) by 379 days.

(21) Appl. No.: 10/059,551

(22) Filed: Jan. 29, 2002

Related U.S. Application Data

(60) Provisional application No. 60/265,772, filed on Jan. 31, 2001.

(51) Int. Cl.[7] ..... A63B 69/06

(52) U.S. Cl. ..... 482/72; 482/95; 482/96; 482/121

(58) Field of Search ..... 482/95, 96, 121, 482/72, 51, 142, 130, 412, 57

(56) References Cited

U.S. PATENT DOCUMENTS

| | | | | |
|---|---|---|---|---|
| 4,071,235 A | | 1/1978 | Zent | |
| 4,538,804 A | | 9/1985 | Zibell | |
| 4,641,833 A | | 2/1987 | Trethewey | |
| 4,684,126 A | | 8/1987 | Dalebout et al. | |
| 4,850,587 A | | 7/1989 | Lin | |
| 4,880,225 A | | 11/1989 | Lucas et al. | |
| 5,378,214 A | | 1/1995 | Kreitenberg | |
| 5,429,565 A | | 7/1995 | Hagg et al. | |
| 5,429,568 A | * | 7/1995 | Chen | 482/96 |
| 5,507,710 A | * | 4/1996 | Chen | |
| 5,518,473 A | | 5/1996 | Miller | |
| 5,527,243 A | * | 6/1996 | Chen | 482/72 |
| 5,580,340 A | * | 12/1996 | Yu | |
| 5,695,434 A | | 12/1997 | Dalebout et al. | |
| 5,695,435 A | | 12/1997 | Dalebout et al. | |
| 5,827,158 A | * | 10/1998 | Drecksel | 482/96 |
| 5,897,459 A | | 4/1999 | Habing et al. | |
| 6,066,073 A | | 5/2000 | Stearns et al. | |

* cited by examiner

*Primary Examiner*—Jerome W. Donnelly

(57) ABSTRACT

A full-body exercise machine. The exercise machine includes a first mechanism that enables a user to selectively apply positive resistance to a first leg and/or a second leg independently or simultaneously. The resistance is applied during pushing and/or pulling motions as the first leg and/or the second leg move in opposite or similar directions relative to the second leg and/or first leg, respectively. A second mechanism selectively applies positive resistance to a first arm and/or a second arm independently or simultaneously, in different or similar directions. The resistance is applied during pushing and/or pulling motions. A third mechanism facilitates abdominal crunches, leg tucks, and/or back hyper-extensions while exercising the legs and the arms via the first and second mechanisms. In a specific embodiment, the third mechanism includes a seatback linked to the first and/or second mechanisms so that actuation of the first or second mechanisms causes actuation of the seatback. Mechanical links are connected between the first mechanism, the second mechanism, and the third mechanism via swivel connectors. A stable seat accommodates the user, which facilitates performing simultaneous tasks, such as reading or watching television.

15 Claims, 4 Drawing Sheets

FULL-BODY ACCORDION-MOTION EXERCISE MACHINE

This application claims priority from U.S. Provisional Patent Application Ser. No. 60/265,772, filed Jan. 31, 2001, entitled ACCORDION METHOD ABDOMINAL CRUNCH ROWING MACHINE, which is incorporated by reference herein.

BACKGROUND OF THE INVENTION

1. Field of Invention

This invention relates to exercise equipment. Specifically, the present invention relates to exercise equipment for providing full-body aerobic and anaerobic workouts and enabling full-body compression and extension resistance exercises.

2. Description of the Related Art

Full-body exercise equipment is employed in various demanding applications including home gym, physical rehabilitation, and Olympic training applications. Such applications demand versatile and configurable exercise equipment that can efficiently target all major muscle groups including abdominal and lower back muscles.

Ideally, a full-body exercise machine facilitates anaerobic and aerobic exercises and efficiently works all major opposing muscle groups, providing a balanced workout and promoting body symmetry. Examples of opposing muscle groups include biceps and triceps, chest and upper back, abdominal muscles and lower back muscles, and quadriceps and hamstrings.

Various conventional exercise machines, such as rowing machines, exercise bicycles, elliptical trainers, stair climbers, the HealthRider™ or Power Rider™, Total Gym™, SoloFlex™, BowFlex™, and home gyms, attempt to provide effective full-body workouts but have various shortcomings. For example, rowing machines provide positive resistance to various muscle groups in one direction only, failing to exercise opposing muscle groups with positive resistance (Positive resistance occurs when lifting, pushing, or pulling against a resistance. Negative resistance occurs when lowering a weight or otherwise extending an extremity in the direction of the resistance.). Consequently, users wishing to perform triceps extensions, for example, must use a different machine. Furthermore, rowing machines are typically limited to a single configuration, wherein both legs and both arms move together in similar directions. This may prematurely exhaust muscle groups before a sufficient aerobic workout is obtained.

U.S. Pat. No. 4,641, 833, by Trethewey, entitled EXERCISE MACHINE, discloses an exercise machine for providing resistance during both pulling and pushing motions. Unfortunately, like conventional rowing machines, the exercise motion is limited and requires both arms and both legs to either push or pull simultaneously. An ideal aerobic workout may require opposite or independent movement of both arms and both legs. Furthermore, during each repetition, the seat elevates, inhibiting the user from performing other simultaneous tasks, such as reading or watching television.

Pedal machines, such as bicycles and elliptical trainers, may include movable handles designed to augment leg workouts with upper body workouts. Exemplary pedal machines are disclosed in U.S. Pat. No. 4,538,804, by Zibell, entitled EXERCISING MACHINE AND METHOD and in U.S. Pat. No. 4,880,225, by Lucas, et al., entitled DUAL ACTION CYCLE EXERCISER. Unfortunately, such devices are often limited to a predetermined motion, such as bicycle pedal motion, and generally do not accommodate other exercises, such as leg presses. In a conventional bicycle pedal motion, one leg extends as the opposite leg bends, which may be undesirable for anaerobic exercise. In addition, maximum resistance is often applied near the middle of the exercise motion between compressed and extended states and not the top or bottom of a particular motion. An optimal workout may require resistance near the top and bottom of the exercise motion. Furthermore, these systems typically lack mechanisms for efficiently exercising the midsection, including abdominal and lower back muscles.

U.S. Pat. No. 4,684,126 to Dalebout, et al., entitled GENERAL PURPOSE EXERCISE MACHINE, may allow exercise of arms and legs via both pushing and pulling motions. Unfortunately, this exercise machine, like previous exercise devices, inadequately exercises the midsection and lacks a mechanism for facilitating sit-ups or back hyperextensions. Furthermore, the exercise machine requires a complex lever system that may be undesirably expensive and unreliable.

U.S. Pat. No. 4,850,587, by Lin, entitled DUAL EXERCISE BICYCLE, discloses a combination exercise bicycle and sit-up machine. Unfortunately, the device is configured to operate as either an exercise bicycle or a sit-up device and may not accommodate both sit-up and bicycle exercises simultaneously. Furthermore, leg motion is limited to bicycle motion. In addition, the device employs a rigid handle connected to an anchored steel rope, which may not provide an effective upper body workout.

Devices such as the HealthRider™ (U.S. Pat. No. 5,695, 434) or Power Rider™ (U.S. Pat. No. 5,695,435) employ body weight to exercise the legs and arms. An exemplary device is disclosed in U.S. Pat. No. 6,066,073 to Stearns, et al, entitled EXERCISE APPARATUS WITH ELEVATING SEAT. Unfortunately, such devices often employ a non-configurable moving seat that may inhibit simultaneous tasks, such as reading or watching television. In addition, positive resistance is typically applied in one direction only, such as when pulling with the arms or pushing with the legs, which limits effective muscle group targeting. Furthermore, these devices may not provide adequate abdominal and lower back exercises.

Total Gym™, SoloFlex™, BowFlex™, and home gyms may target multiple muscle groups with both positive and negative resistance. Unfortunately, these systems often require undesirably numerous and complex body positions and motions to effectively achieve a full-body workout. In addition, these exercise systems provide relatively inadequate full-body aerobic workouts.

Conventional exercise equipment is generally adapted for aerobic or anaerobic exercise and not both. Allowable motions, resistance levels, and resistance directions are often limited from any given sitting position and generally do not provide positive resistance during both extension and compression (curl) exercises for all major limbs of the body, including the torso. Ideally, a full-body workout machine efficiently exercises all major muscle groups with both positive and negative resistance. Furthermore, combined motions involving conventional exercise equipment often neglect the midsection. These factors may significantly reduce the overall functionality and effectiveness of the exercise equipment.

Hence, a need exists in the art for an efficient, versatile, and adjustable system that facilitates full-body aerobic and anaerobic exercise by enabling curls and extensions of the major limbs of the body, including the torso (sit-ups and back hyperextensions), legs (leg raises, extensions, and curls), arms (arm extensions, curls, and pull-backs), and feet (calf raises and toe pull-backs), thereby enabling exercise of all major muscle groups, including the chest and shoulders.

SUMMARY OF THE INVENTION

The need in the art is addressed by the full-body exercise machine of the present invention. In the illustrative embodiment, the inventive exercise machine is adapted for use with full-body compression and extension exercises. The exercise machine includes a first mechanism that enables a user to selectively apply positive resistance to a first leg and/or a second leg independently or simultaneously. The resistance is applied during pushing and/or pulling motions. The first leg and/or the second leg move in opposite or similar directions relative to the second leg and/or first leg, respectively. A second mechanism enables the user to selectively apply positive resistance to a first arm and/or a second arm independently or simultaneously, in different or similar directions. The resistance is applied during pushing and/or pulling motions. A third mechanism facilitates abdominal crunches, leg tucks, and/or back hyperextensions while exercising the legs and the arms via the first and second mechanisms.

In a specific embodiment, the third mechanism includes a seatback linked to the first and/or second mechanisms so that actuation of the first or second mechanisms causes actuation of the seatback. Force applied to the exercise machine via the first arm and/or second arm affects resistance felt by the first leg and/or the second leg and affects resistance to motion of the seatback.

A fourth mechanism enables the user to immediately change their exercise focus from one muscle group to another muscle group while performing a similar exercise motion and without changing positions or adjusting the exercise machine. The fourth mechanism includes mechanical links between the first mechanism, the second mechanism, and the third mechanism. The mechanical links connect the first, second, and third mechanisms via swivel connectors.

The exercise machine includes a stable seat that accommodates the user, facilitating operation of the first, second, third, and fourth mechanisms. A fifth mechanism, employed by the first and second mechanism, enables the user to selectively adjust resistance levels felt by the arms and legs at different portions of the exercise motion to enable target loading of specific muscles or sections thereof.

The novel design of the present invention is facilitated by the third mechanism, which promotes a fully-body workout by incorporating the torso in the overall exercise motion, which includes curls and extensions of all major limbs of the body. By controlling the resistance felt by each limb via the first and second mechanisms, efficient full-body aerobic and anaerobic exercise is achieved. Unlike conventional exercise machines, the present invention can exercise virtually every major muscle with aerobic or anaerobic exercise with a single overall motion. By providing an effective full-body workout incorporating the midsection, the present invention enables users to more rapidly improve their overall health and appearance.

DESCRIPTION OF THE INVENTION

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

For the purposes of the present discussion, an exercise machine is any structure having a framework with moving parts designed to facilitate exercise. Consequently, apparatuses consisting of tension bands alone, which lack frames, are not considered exercise machines.

Figure 1:
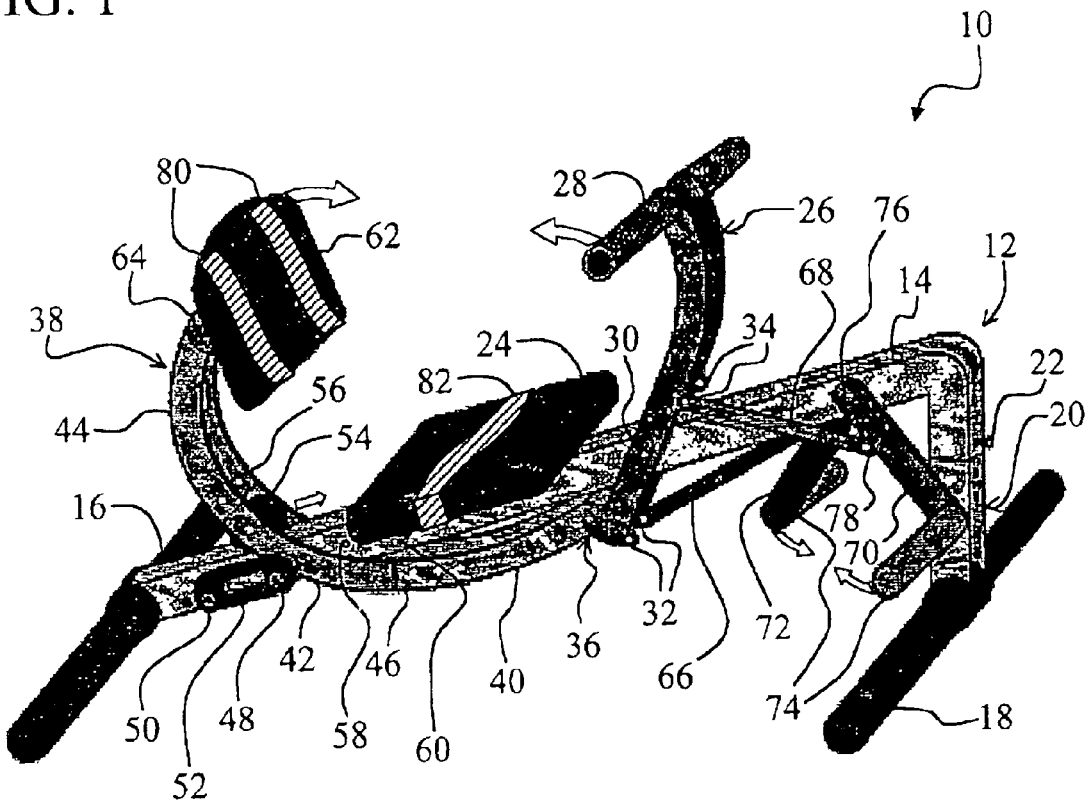
FIG. 1 is a perspective view of a first embodiment of an exercise machine of the present invention in a first configuration.

FIG. 1 is a perspective view of a first embodiment 10 of an exercise machine of the present invention in a first configuration. The exercise machine 10 includes a stable frame 12 having a main center support beam 14. The support beam 14 is connected to a rear stabilizer 16 at a rear end of the support beam 14 and to an adjustable vertical support beam 20 at a front end of the support beam 14. The vertical support beam 20 is stabilized via a front stabilizer 18 and includes an adjustable pin connector 22 that enables the support beam 20 to be selectively lengthened.

A stable seat 24 is mounted on the frame 12 behind an arm lever 26. Handle bars 28 are mounted on top of the arm lever 26, which is rotationally connected to the frame 12 via a first swivel connector 30. Motion of the arm lever 26 is approximately confined to a vertical plane coincident with the main support member 14 of the frame 12 as the arm lever 26 pivots about the swivel connector 30. The handlebars 28 are removable.

The arm lever 26 includes front-facing lower swivel connectors 32 that are connected to a bottom portion of the arm lever 26 below the first swivel connector 30. Front-facing upper swivel connectors 34 are connected to the arm lever 26 above the first swivel connector 30. The arm lever 26 also includes rear-facing lower swivel connectors 36 opposite the front-facing lower swivel connectors 32.

In the present specific embodiment, the arm lever 26 is slightly curved backward toward the seat 24. The portion of the lever arm 26 above the upper swivel connectors 34, including the handles 28, may be removed without departing from the scope of the present invention.

The rear-facing lower swivel connectors 36 connect the arm lever 26 to a front section 40 of a back support lever 38. The back support lever 38 includes a rear section 44, a midsection 42, and the front section 40. The front section 40 is connected to the midsection 42 via an adjustable connector 46 that allows the front end of the midsection 42 to readily connect at various positions along the front section 40. This adjustable connector 46 enables a user to easily adjust the effective length of the combined midsection 42 and front section 40.

A first pin 48 extending from the surface of the midsection 42 of the back support lever 38 and a corresponding second pin 50 extending from a side of the main support beam 14 behind the midsection 50 accommodate a tension band 52. An additional third pin 60 extends from a side of the main support beam 14 in front of the second pin 48. The third pin 60 allows for a tension band to be placed around the second pin 48 and the third pin 60 in place of or in addition to the tension band 52, as discussed more fully below.

The midsection 42, which straddles the main support beam 14, also straddles a wheel 54 that is connected to the midsection 42. The wheel 54 is positioned relative to the midsection 42 and the main support beam 14 of the frame 12 so that the wheel 54 may roll along a top surface of the main support beam 14 behind the seat 24 as the midsection 42 straddles the main support beam 14. The wheel 54 and the rear-facing swivel connectors 36 support the back support lever 38 relative to the frame 12.

The rear section 44 of the back support member 38 is detachably connected to the midsection 42 via a detachable connector 56 at a lower end. An upper end of the rear section 44 is connected to an adjustable back support connector 64, which connects a seatback 62 to the rear section of the back support lever 44. The adjustable back support connector 64 facilitates angular position adjustments of the seatback 62. The rear section 44, the midsection 42, and the front section 40 of the back support lever 44 are slightly curved so that the entire back support lever 38 is curved up sufficiently to position the seatback 62 in a desired exercise position. The exact curvature of the back support lever 44 is application-specific and may be determined by one skilled in the art to meet the needs of a given application. Furthermore, the detachable connector 56 may be replaced with an adjustable tightening swivel connector that allows the angle of the rear section 44 relative to the midsection 42 to be adjusted to thereby adjust the overall position of the seatback 62.

The detachable connector 56 connecting the rear section 44 to the midsection 42 facilitates separation of the rear section 44 from the midsection 42. A connector hole 58 in the main support beam 14 behind the seat 24 is designed to accommodate the detachable connector 56. Hence, the detachable connector 56 also facilitates fastening the rear section 44 to the main support beam 14 of the frame 12 at the connector hole 58 via screws or other mechanisms. Those skilled in the art will appreciate the connector hole 58 may be replaced with plural connector holes or other fastening mechanisms without departing from the scope of the present invention.

The lower swivel connectors 32 of the arm lever 26 selectively connect to a left linking rod 66 and/or a right linking rod 68, depending on the selected configuration. Similarly, the upper swivel connectors 34 of the arm lever 26 selectively connect to the left and/or right linking rods 66 and 68, respectively. In the configuration shown in FIG. 1, the left linking rod 66 is connected to the left lower swivel connector 32, while the right linking rod is connected to the right upper swivel connector 34. The linking rods 66 and 68 may pivot about the respective swivel connectors 32 and 34.

The front ends of the left and right linking rods 66 and 68 are connected to left and right foot levers 72 and 70, respectively, via front swivel connectors 78. The left foot lever 72 and the right foot lever 70 pivot about a foot-lever swivel connector 76 that is mounted on the main support beam 14 of the frame 12 in front of the first swivel connector 30. The foot-lever swivel connector 76 allows the foot levers 72 and 70 to pivot independently when not connected to the corresponding linking rods 66 and 68. When the foot levers 72 and 70 are connected to the linking rods 66 and 68, which are linked to the arm lever 26 as shown in FIG. 1, the foot levers 72 and 70 move in opposite pendular motions as the arm lever 26 pivots about the first swivel connector 30, and the back support lever 38 rolls along the main support beam 14 of the frame 12. The foot levers 72 and 70 are connected to foot supports 74 that extend perpendicular to the levers 72 and 70.

In the present specific embodiment, the seatback 62 has shoulder straps 80, and the seat 24 has a seat belt 82. The shoulder straps 80 and seat belt 82 allow a user to employ the exercise machine 10 as a sit-up machine only or a combination sit-up machine and back hyper-extension machine only when an additional tension band 52 is connected around the second pin 48 and the third pin 60. The foot supports may include foot straps or toe clips (not shown) to secure the feet on the foot supports 74. Sit-ups and back hyperextensions are performed by curling and extending the torso, respectively.

In operation, a user sits on the stable seat 24 with the seat belt 82 fastened; their back against the seatback 62 and the shoulder straps 80 around their shoulders; their hands gripping the handle bars 28; and their feet on the foot supports 74. As the user pulls forward on the handle bars 28; pulls forward with the right leg and foot via the right foot lever 70; pushes forward with the left leg and foot via the left foot lever 72; and/or moves the torso forward (performing a crunch), the tension band 52 elongates as the wheel 54 rolls up the incline along the main support beam 14 of the frame 12. The amount of force applied by the user to the arm lever 28, the foot levers 72 and 70, and the seatback 62 to work against the resistance from the tension band 52 is user-controllable. When the tension band 52 stretches, the sum of the forces applied by the user via the levers 38, 26, 72, and 70 counteracts the resistance of the tension band 52 and the component of gravity pushing the wheel 54 down the main support beam 14. Consequently, to stretch the tension band 52, a user may simply change their focus to apply more force to different body parts without changing positions or motions. Hence, unlike conventional full-body workout machines, the exercise machine 10 allows all major muscle groups and associated body limbs, including the torso, to be thoroughly exercised to varying degrees and with varying types of resistance (both positive and negative) without changing positions.

For the purposes of the present discussion, a limb, such as a leg or arm, is in a compressed position when the limb is bent or curled at one extremre of the exercise motion. A limb is in an extended position when straightened at another extreme of the exercise motion.

As the user pulls their arms forward while holding onto the handle bars 28, their arms move from an extended to a compressed position against positive resistance provided by the tension band 52 and gravity. When the user curls their right leg with their foot on the foot support 74, their right leg moves from an extended to a compressed position under positive resistance provided by the tension band 52 and gravity. Simultaneously, their left leg moves from a compressed position to an extended position, performing a leg press or leg extension against positive resistance. Similarly, as the user moves their shoulders forward, pulling the seatback 62 forward via the shoulder straps 80, their torso moves from a partially extended position to a more compressed position, performing an abdominal crunch against positive resistance. Abdominal crunch and arm rowing motions occur simultaneously.

Switching the tension band 52 from between the first pin 50 and the second pin 48 to between the second pin 48 and the third pin 60, causes the direction of resistance to be switched. In this configuration, the handles 28 move forward under positive resistance and move backward under negative resistance. The seatback 62 moves backward under positive resistance and forward under negative resistance. Right leg curls occur under negative resistance, and right leg extensions occur under positive resistance. Left leg extensions occur under negative resistance, and left leg curls occur under positive resistance. In this configuration, back hyperextensions are performed as the user extends their torso from a relatively compressed position to a relatively extended position. Back hyperextensions and chest presses may occur simultaneously.

By equipping the foot supports 74 with toe clips or foot straps, foot extensions (calf raises) and foot curls (ankle curls) are more easily incorporated into the overall exercise motion. Calf raises and foot curls may be performed without the use of toe clips or foot straps by selectively positioning the feet relative to the foot supports 74. For example, when the toes are placed under the foot supports and moved backward, i.e., curled from an extended position against positive resistance, foot curls are performed. Thus, the exercise machine 10 may also work muscles on the front and rear portions of the lower leg including calf muscles such as the gastrocnemius and soleus in the rear side of the lower leg and tibialis, extensor hallucis longus, and extensor digitorum longus muscles in the front of the lower leg.

A user may also grip the handlebars 28 with their fingertips and with their palms facing downward, extending and curling their fingers as part of the overall exercise motion. This exercises finger and forearm muscles. Switching grips so that the palms face upward instead of downward may shift the load to different finger and forearm muscles.

To exercise side stomach muscles, such as intercostals and abdominal obliques, the user may employ one of the shoulder straps 80 at a time. As the user attempts to prevent torso twisting, the side abdominal muscles are exercised.

Hence, the exercise machine 10 of the present invention efficiently accommodates several exercises, such as leg raises and extensions, calf raises and curls, forward and reverse grip arm curls that also exercise various back muscles, such as the latissimus dorsi, chest presses, back hyperextensions, abdominal crunches, and so on. The various exercises may efficiently target several muscle groups simultaneously or independently via a single overall motion and in different combinations independently and simultaneously. For example, a user may simultaneously target abdominal muscles, biceps, forearms, shoulders, upper back, buttocks, and hamstrings. Alternatively, the user may target abdominal muscles, triceps, shoulders, chest, upper back, lower back, buttocks, and quadriceps simultaneously. Other combinations of target muscle groups may be exercised by changing mental focus to apply more effort via different body parts. Different muscle groups or portions thereof are further isolated by reconfiguring the machine 10 by adjusting the position or resistance of the tension band 52, the elevation of the front vertical support beam 20, the positions of the linking rods 72 and 70, the angle of the seatback 62, the motion of the seatback 62, the position of the stable seat 24 (via the swivel connector 64, and connectors 56, 46, and 58), and so on.

Hence, unlike conventional full-body exercise machines, the exercise machine 10 can exercise virtually every major muscle group via a single overall motion, from a single sitting position, and with minimal impact on joints or skeletal structures. Furthermore, the exercise machine 10 facilitates both aerobic and anaerobic exercise. Removing the tension band 52 or replacing the tension band with a different band reduces the resistance felt at the various levers 38, 26, 72, and 70, thereby facilitating aerobic or cardiovascular exercise. Employing stronger tension bands or several tension bands and/or increasing the elevation of the front end 20 facilitates anaerobic or resistance exercise.

By connecting an additional tension band between the second pin 48 and the third pin 60, positive resistance may be applied during both pulling and pushing motions. In this case, various interconnected levers 38, 26, 72, and 70 of the exercise machine 10 will rest in an initial position in stable equilibrium. The user will experience positive resistance when attempting to move the levers from the stable initial position. To prevent the initial position from occurring at extremes of the ranges of motion of the levers 38, 26, 72, and 70, the distances between the pins 48, 50, 60 and the strengths of the tension bands 52 are selected so that one tension band does not dominate the other. In most applications, the equilibrium position is selected so that the various levers 38, 26, 72, and 70 are midway between their allowable ranges of motion.

The tension band 52 may be implemented via several tension bands. Alternatively, the tension band 52 may be omitted as a source of resistance, and the front end 20 of the frame 12 may be selectively elevated to adjust the resistance provided by gravity. In addition, one or more of the various swivel connectors, such as the first swivel connector 30 or the foot-lever swivel connector 76, may be adjustable to control the resistance to pivoting. Such adjustable swivel connectors may be readily constructed or ordered by one skilled in the art. A knob, as discussed more fully below, may be employed to tighten a swivel connector, increasing pivot resistance. By selectively tightening one or more appropriate swivel connectors, positive resistance is applied to all motions of the exercise machine 10.

The dimensions of the frame 26 and various components of the exercise machine 10 and amounts by which the dimensions may be adjusted are application-specific and may be readily determined by one skilled in the art with access to the present teachings to meet the needs of a given application.

Those skilled in the art will appreciate that the rear stabilizer 16 may be connected to an adjustable support beam (not shown) to facilitate elevation adjustment of the rear end of the frame 12 without departing from the scope of the present invention. Furthermore, other sources of resistance, such as hydraulic cylinders, electrically controlled hinges, and weights attached to the seatback 62 or to the back support lever 38, may be employed. For example, the seatback 62 may conceal a weight or a compartment for inserting weights (not shown). In addition, the positions of the pins 50, 48, and 60 may be adjustable to allow the user to change the extent to which the tension bands stretch during a particular exercise. This enables a user to target load certain muscles and portions thereof by selectively adjusting the resistance occurring at any position during the overall exercise motion. Furthermore, additional pins and tension bands (not shown) may be included on the opposite side of the exercise machine 10 and/or in other positions, such as from the seatback 62 to the rear support 16, without departing from the scope of the present invention.

The exercise machine 10 is readily adjustable to accommodate various sized users. The position of the seatback 62 is adjustable forward, backward, upward, downward. The lengths of the various components, such as the foot supports 74, foot levers 72 and 70, and the arm lever 26 and the positions of the handles 28 may be made readily adjustable via various well-known mechanisms, such as telescoping or folding mechanisms (see the pin connector 22).

The exercise machine 10 readily accommodates handicap or injured users that may have only limited use of various limbs. Individuals lacking use of one or both legs, for example, may have difficulty exercising via conventional exercise equipment, such as exercise bicycles. The exercise machine 10 of the present invention allows the user to exercise only those legs or other limbs that require exercising.

Figure 2:
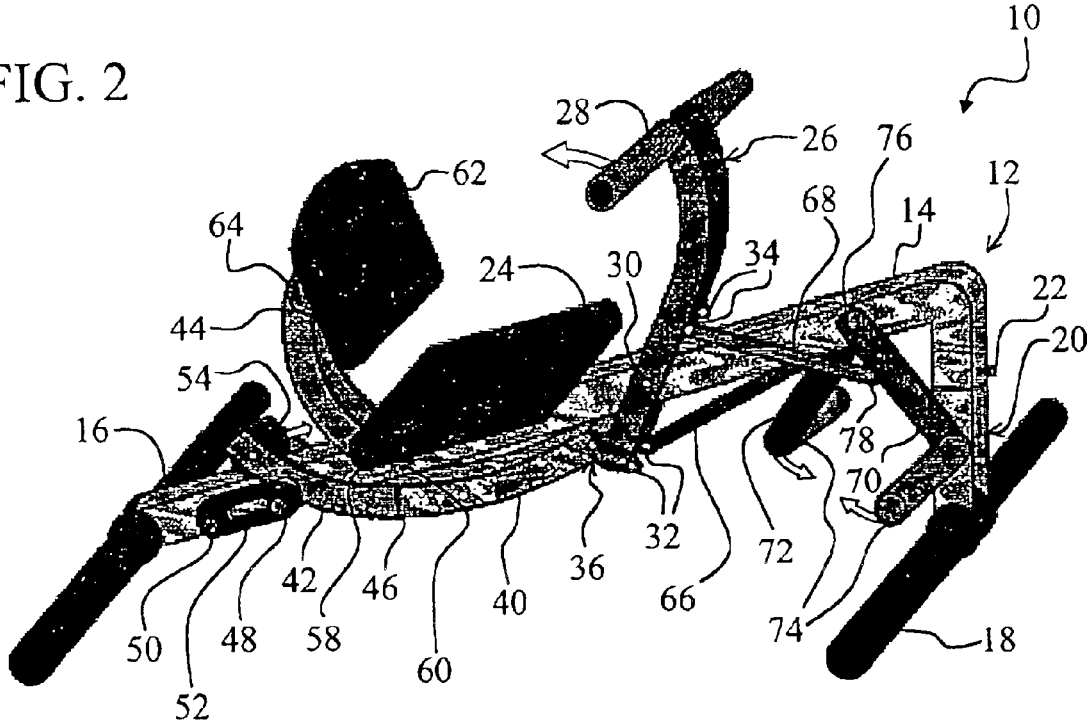
FIG. 2 is a perspective view of the exercise machine of FIG. 1 in a second configuration with a stable seatback.

FIG. 2 is a perspective view of the exercise machine 10 of FIG. 1 in a second configuration with a stable-backrest 62. The rear section 44 of the back support lever 38 of FIG. 1 is detached from the midsection 42 and fastened to the stable main support beam 14 at the connector hole 58. Consequently, the seatback 62 remains in a stable position when exercising. This stable position facilitates performing simultaneous tasks, such as reading or watching television. Even in the stable position, the user may exercise abdominal muscles by connecting the left linking rod 66 to the left upper front-facing swivel connector 34 and performing leg tucks.

Figure 3:
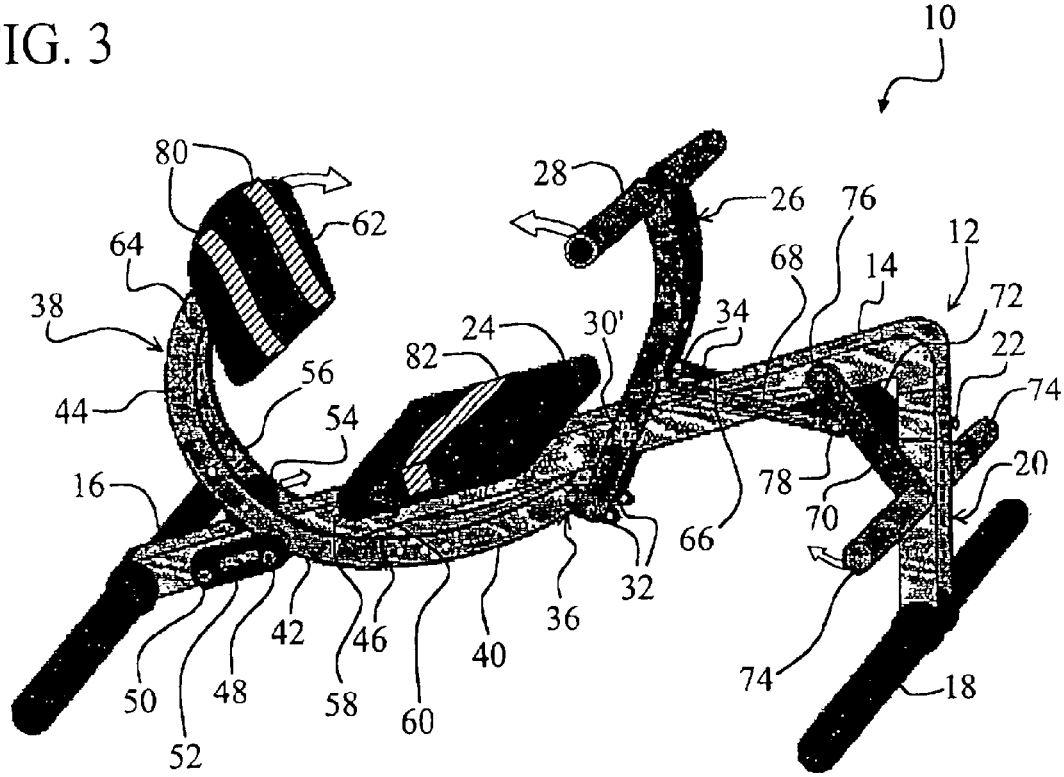
FIG. 3 is a perspective view of the exercise machine of FIG. 1 in a third configuration with parallel foot rests facilitating simultaneous abdominal crunches, leg curls, and arm pulling (rowing) exercises.

FIG. 3 is a perspective view of the exercise machine 10 of FIG. 1 in a third configuration with parallel foot rests 74 facilitating simultaneous abdominal crunches, leg curls, and rowing exercises. For the purposes of the present discussion, the terms arm pullbacks, rowing exercises, and lat pull backs, are employed interchangeably.

The configuration of FIG. 3 is similar to the configuration of FIG. 1 with the exception that the left linking rod 66 is connected to the left upper front-facing swivel connector 34; the vertical support beam 20 is slightly extended; and the first swivel connector 30 is replaced with an adjustable resistive swivel connector 30'. Both legs move simultaneously in similar directions. The adjustable swivel connector 30' is selectively tightened via a knob to increase the pivot resistance. In this configuration, the tension band 52 may be removed. Tightening the adjustable swivel connector 30' may partially compensate for the missing tension band. However, resistance applied via the adjustable swivel connector 30' affects resistance to motion of the exercise machine 10 differently than the tension band 52.

Use of the tension band 52 creates an initial stable equilibrium position that the exercise machine 10 returns to when not in use. Use of the knob 30' causes all positions to be relatively stable. By using the combination of the knob 30', the tension band 52, and the elevation of the front end 20, the resistive behavior of the machine 10 is adjusted to target different portions of different muscles. For example, during leg presses, additional resistance at the end of the motion may emphasize the upper hamstrings, buttocks, and quadriceps. Additional resistance at the beginning of leg presses may emphasize lower portions of the same muscle groups. Hence, unlike conventional full-body exercise machines, a user may effectively target load individual muscles or muscle groups via the exercise machine 10.

Figure 4:
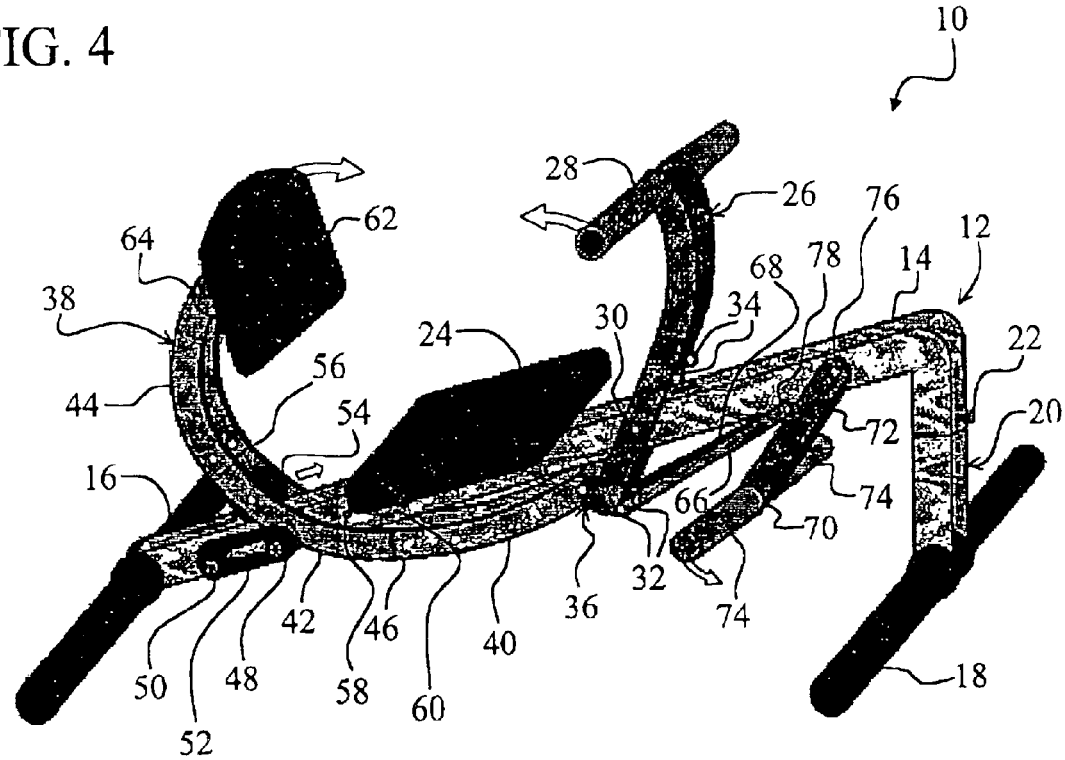
FIG. 4 is a perspective view of the exercise machine of FIG. 1 in a fourth configuration with parallel foot rests facilitating simultaneous abdominal crunches, leg extensions, and rowing exercises.

FIG. 4 is a perspective view of the exercise machine 10 of FIG. 1 in a fourth configuration with parallel foot rests facilitating simultaneous abdominal crunches, leg extensions, and rowing exercises. The configuration of FIG. 4 is similar to the configuration of FIG. 1 with the exception that the right linking rod 68 is connected to the left lower front-facing swivel connector 32, which brings the right foot lever 70 forward and parallel to the left foot lever 72. In this configuration, both feet move forward simultaneously as the handles 28 move backward, and the seatback 62 moves forward. Hence, the user may perform a leg press, a row, and a sit-up simultaneously.

Figure 5:
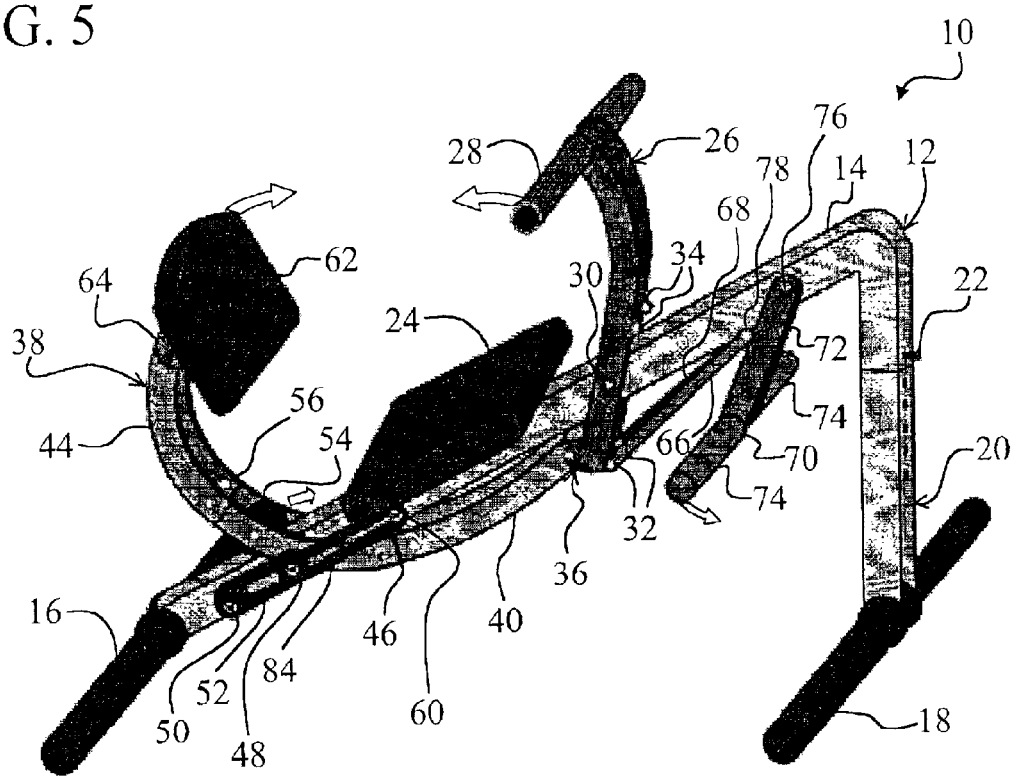
FIG. 5 is a perspective view of the exercise machine of FIG. 1 in a fifth configuration for facilitating target loading of specific muscles.

FIG. 5 is a perspective view of the exercise machine 10 of FIG. 1 in a fifth configuration for facilitating target loading of certain muscle groups. The configuration of FIG. 5 is similar to the configuration of FIG. 4 with the exception that the vertical support beam 20 is fully extended to maximize the resistance provided by gravity, and that an additional tension band 84 is connected from the second pin 48 to the third pin 60.

When the height of the vertical support beam 20 is increased as shown in FIG. 5, gravity acts to increase the difficulty of sit-ups or abdominal crunch motions performed via the exercise machine 10. Furthermore, the user may rest their back on the seatback 62 to increase resistance felt by arms and legs when pulling and pushing on the arm lever 26 and foot levers 72 and 70, respectively. The weight of the user's upper body resting on the seatback 62 increases as the elevation of the vertical support beam 20 increases.

In the configuration of FIG. 5, the tension band 84 between the second pin 48 and the third pin 60 is weaker than the tension band 52 between the first pin 50 and the second pin 48. Consequently, the first tension band 52 dominates, and the initial equilibrium position of the exercise machine 10 is at a first extreme. In this case, the additional tension band 84, which is stretched, counteracts the tension provided by the first tension band 52 until the second tension band 84 enters a non-stretched position, at which point, the second tension band 84 may partially buckle. When the second tension band 84 is approximately limp, the full strength of the first tension band 52 is felt by the user. Consequently, the first part of the exercise motion is easier, while the later part of the motion, when the legs are extended, becomes more difficult, as the counteracting tension from the buckling second tension band 84 subsides and no longer counteracts the tension of the first tension band 52. Hence, strategic use of tension bands of varying strength may be employed to efficiently adjust the resistance felt at different portions of the exercise motion. This facilitates target loading of various muscle groups and sections.

If the user does not have various tension bands of different strengths, tension bands of similar strengths may be employed to achieve a similar effect. However, in this case, the distances between the pins 50, 48, and 60 are selectively adjusted to achieve the desired effect. The position of the pins 50, 48, and 60 along the main support beam 14 are adjustable via an adjustable mechanism (not shown). Systems and methods for making the position of pins adjustable are known in the art and may be constructed and incorporated into the present exercise machine 10 without undue experimentation.

Resistance during both pulling and pushing motions is achieved by adjusting the strengths of the tension bands 52 and 84 and/or the positions of the pins 50, 48, and 60, so that the initial equilibrium position of the exercise machine 10 is between extreme positions. In the present configuration, midway between extreme positions, the foot levers 72 and 70 are approximately perpendicular to the main support beam 14.

Figure 6:
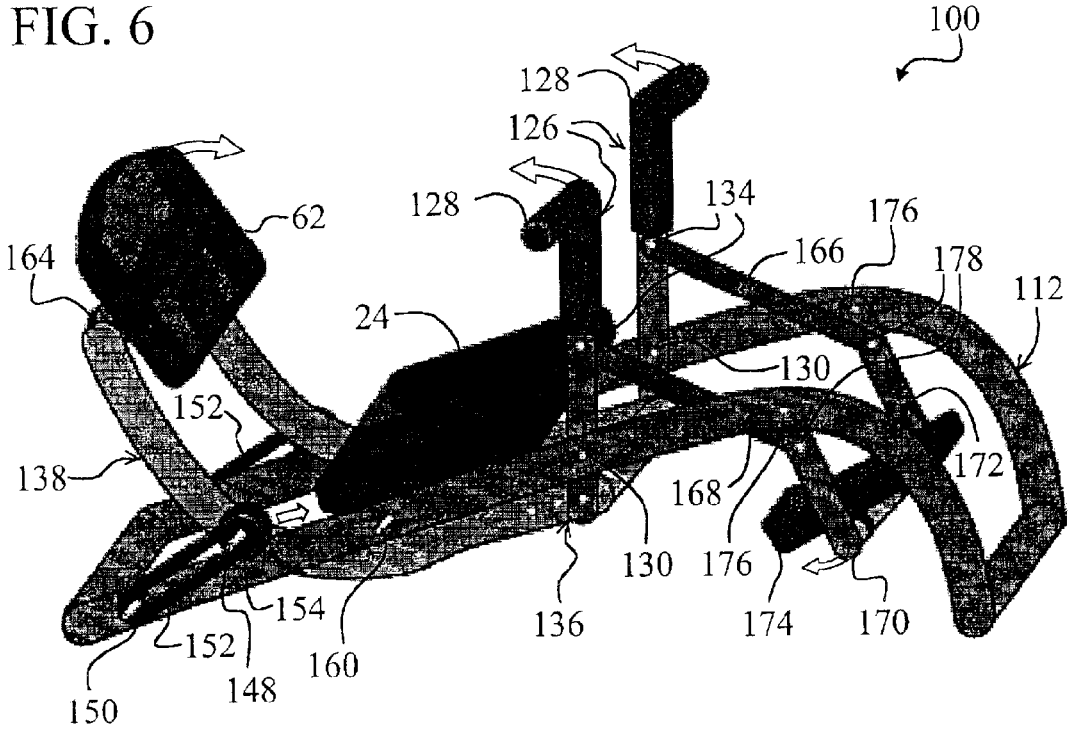
FIG. 6 is a perspective view of a first alternative embodiment of the present invention.

FIG. 6 is a perspective view of a first alternative embodiment 100 of the present invention. The operation of the alternative exercise machine 100 is analogous to the operation of the exercise machine 10 of FIG. 3. With reference to FIGS. 3 and 6, the frame 12 of FIG. 3 is replaced with the frame 112 of FIG. 6, which supports the stable seat 24 via columns on either side of the seat 24 rather than via the main support beam 14 of FIG. 3. The single arm lever 26 of FIG. 3 is replaced by dual arm levers 126 with handles 128. The back support lever 38 is replaced by a back support lever 138, which supports the seatback 62 via a wide seat swivel connector 164.

The back support lever 138 rides up and down along the frame 112 via wheels 154 mounted on the back support lever 138 and positioned opposite sides of the frame 112. The wheels 154 have concentric pins 148 that are coaxial with the wheels 154. The pins 148 accommodate tension bands placed around the pins 148 and around one or more rear pins 150 and front pins 160 mounted on the frame 112. The wide back support lever 138 is curved so that a front end of the support lever 138 connects with lower ends of the arm levers 126 below swivel connectors 130 connecting the arm levers 126 to the frame 112 in front of the seat 24. The wide back support lever 138 connects with the arm levers 126 via an adjustable connector 136. The adjustable connector 136 allows the arm levers 126 to connect to the back support lever 138 at different lateral positions, enabling adjustment of the displacement of the seatback 62 relative to the stable seat 24.

The arm levers 126 connect to left and right linking rods 166 and 168 at upper swivel connectors 134. The linking rods 166 and 168 connect to foot levers 172 and 170 at swivel connectors 178 positioned below lever swivel connectors 176 connecting the foot levers 172 and 170 to the frame 112. The foot levers 172 and 170 support a footrest 174.

The various component dimensions of the exercise machine 100 provided herein are for illustrative purposes and may be changed by one skilled in the art to meet the needs of a given application without departing from the scope of the present invention. In the present specific embodiment, the frame 112 is approximately 30 inches wide and 72 inches long. The frame 112 is made out of, but not limited to, tubular material that can easily withstand the heaviest users.

The seatback 62 may swivel vertically about the seatback swivel connector 64 with light resistance to pivoting so that the angle of the seatback 62 automatically adjusts to accommodate the angle of the user's back to accommodate the user's body movements. The swivel connector 64 may also be locked in place by tightening a knob (not shown) connected to the swivel connector 64.

In the present embodiment, the wheels 154 are positioned approximately 20 inches below the seatback swivel connector 64. The wheels 154 are connected to the back support lever 138 via a spindle or axle so that the wheels 154 spin freely. The axle of the wheels 154 may or may not be coincident with the center pins 148. The wheels 154 have a concave rolling surface designed to securely roll along the tubular frame 112.

The two arm levers 126 are connected to the frame 112 at the swivel connectors 130 on the inner aspect of the frame 112 in front of the stable seat 24. The arm levers 126 are approximately 25 inches long. The swivel connectors 130 are positioned approximately 7 inches from the bottom of the arm levers 126. The distances between the upper swivel connectors 134 connecting the linking rods 166 and 168 to the arm levers 126 and the swivel connectors 130 connecting the arm levers 126 to the frame 112 are approximately 12 inches.

Alternatively, the lever arms 128 may be extended below the swivel connectors 130 to accommodate additional swivel connectors (analogous to connectors 32 of FIGS. 1–5) positioned below the swivel connectors 130 on the lever arms 128. The additional swivel connectors enable the left linking rod 166 and the right linking rod 168 to be selectively connected thereto. Furthermore, the single foot support 174 may be split so that the lever arms 172 and 170 may move in different directions like in the embodiments of FIGS. 1–5.

The distance between the swivel connectors 130 and the bottom of the arm levers 126 and the shape of the back support lever 138 determine the motion of the seatback 62 in response to movement of the handles 128. The larger the distance between the swivel connectors 130 and the bottom of the arm levers 126, the greater the forward and backward motion of the seatback 62. The arm levers 126 may have a series of additional connector points and corresponding swivel connector mechanisms (not shown) to allow a user to adjust the distances between swivel connectors 130 and the bottom of the arm levers 126 to adjust the relative motion of the seatback 62 and the handles 128. In the present specific embodiment, moving the handles 128 back approximately ten inches causes the seatback 62 to move approximately five inches forward. Hence, the movement ratio is approximately 2:1.

The front lever swivel connectors 176 are positioned approximately 18 inches from the front of the frame 112. The foot levers 172 and 170 are approximately 12 inches long. The foot support 174 is approximately 14 inches long (front to back) and 14 inches wide (side to side). While the foot support 174 is shown as a single platform, two separated platforms, one for each foot lever 172 and 170, may be employed without departing from the scope of the present invention.

The embodiment of FIG. 6 is discussed more fully in U.S. Provisional Patent Application Ser. No. 60/265,772 filed Jan. 31, 2001 entitled ACCORDION METHOD ABDOMINAL CRUNCH ROWING MACHINE, which is assigned to the assignee of the present invention and incorporated herein by reference.

Figure 7:
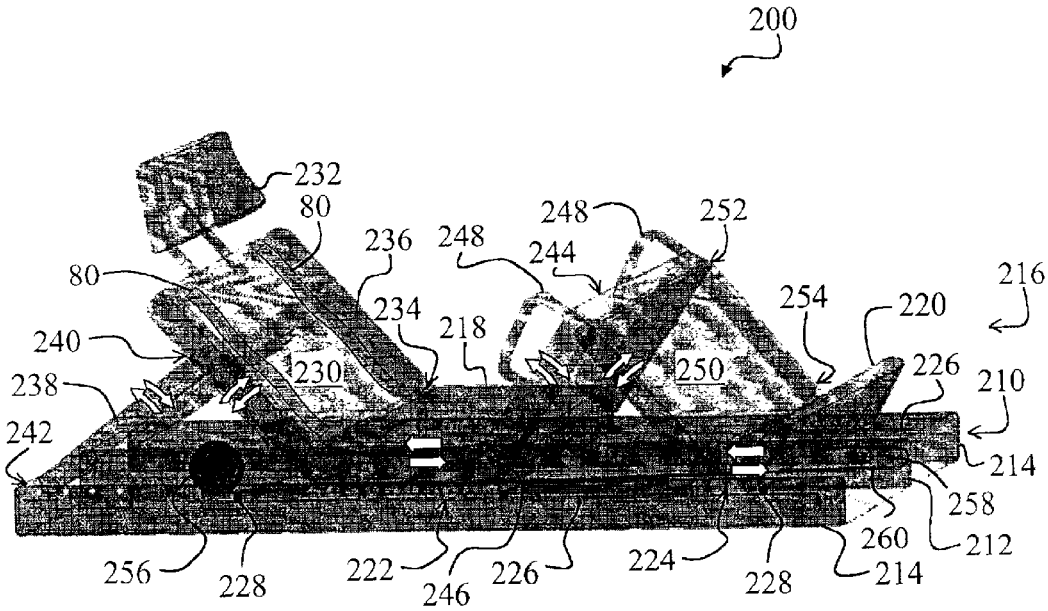
FIG. 7 is a perspective view of a second alternative embodiment of the present invention.

FIG. 7 is a perspective view of a second alternative embodiment 200 of the present invention. The exercise machine 200 includes a frame base 210 that has three parallel and horizontal base support members, including a center support member 212, and two outside support members 214. A moving exercise assembly 216 is mounted on the support members 212 and 214.

The exercise assembly 216 includes sliding seat 218 and a sliding foot support 220 that ride along seat rollers 222 and foot support rollers 224, respectively. The seat rollers and foot support rollers 224 ride in roller tracks 226 mounted on the outside supports 214. The ranges of the rollers 22 and 224 are confined via bumper stops 228, which are strategically placed in the roller tracks 226.

A back support member 230, which has a partially planar supporting surface, is rotatably hinged to the back end of the sliding seat 218 via a hinge 234, which acts as a swivel connector. The back support member 230 is fitted with an optional headrest 232. Rear back support rods 238 are connected to the seatback 230 near a top portion of the seatback 230 via seatback swivel connectors 240. At opposite ends, the back support rods 238 are connected to the outside supports 214 via rear swivel connectors 242 that are positioned sufficiently behind the seatback 230 to cause the seatback 230 to prop up when the sliding seat 218 is moved backward.

The front end of the sliding seat 218 is rotatably connected to a hamstring support member 244 at a front hinge 246. The hamstrings-support member 244 has a partially planar supporting surface with handles 248 connected on either side. The position of the handles 248 along the sides of the hamstring-support member 244 is adjustable.

The hamstrings support member 244 is rotatably connected to a calf-support member 250 at a left end of the calf-support member 250 via a top hinge 252. The calf support member 250 has a partially planar surface. The calf-support member 250 is rotatably connected to the foot support 220 at a lower hinge 254.

The center support member 212 has tension band wheels 256 and 258 that accommodate a tension band 260. Then tension band 260 is connected at one end to the sliding seat 218, wraps around the left support wheel 256 and the right support wheel 258, connecting to the foot support member 220 at an opposite end. The center support member 212 is selectively rigged with the tension band 260 so that a user sitting on the sliding seat 218 feels resistance from the tension band 260 when sliding the seat 218 and/or the foot support 220 forward and/or backward.

The various components of the moving exercise assembly 216 are mechanically linked so that full-body compression and extension exercises, whether aerobic or anaerobic, exercising major limbs of the body, are readily performed. A user sits on the seat support 218 with the feet on the foot support 220, hands on the handles 248, and back on the back support 230, and then extends or curls their various limbs to achieve the desired exercise. Like the exercise machine 10 of FIG. 1, the exercise machine 200 facilitates full-body extension and compression exercises of the major limbs of the body, including the torso.

Force applied via the various levers 230, 244, and 250 work against a common connectors 242 that are positioned sufficiently behind the seatback 230 to cause the seatback 230 to prop up when the sliding seat 218 is moved backward.

The front end of the sliding seat 218 is rotatably connected to a hamstring support member 244 at a front hinge 246. The hamstrings-support member 244 has a partially planar supporting surface with handles 248 connected on either side. The position of the handles 248 along the sides of the hamstring-support member 244 is adjustable.

The hamstrings support member 244 is rotatably connected to a calf-support member 250 at a left end of the calf-support member 250 via a top hinge 252. The calf support member 250 has a partially planar surface. The calf-support member 250 is rotatably connected to the foot support 220 at a lower hinge 254.

The center support member 212 has tension band wheels 256 and 258 that accommodate a tension band 260. Then tension band 260 is connected at one end to the sliding seat 218, wraps around the left support wheel 256 and the right support wheel 258, connecting to the foot support member 220 at an opposite end. The center support member 212 is selectively rigged with the tension band 260 so that a user sitting on the sliding seat 218 feels resistance from the tension band 260 when sliding the seat 218 and/or the foot support 220 forward and/or backward.

The various components of the moving exercise assembly 216 are mechanically linked so that full-body compression and extension exercises, whether aerobic or anaerobic, exercising major limbs of the body, are readily performed. A user sits on the seat support 218 with the feet on the foot support 220, hands on the handles 248, and back on the back support 230, and then extends or curls their various limbs to achieve the desired exercise. Like the exercise machine 10 of FIG. 1, the exercise machine 200 facilitates full-body extension and compression exercises of the major limbs of the body, including the torso.

Force applied via the various levers 230, 244, and 250 work against a common resistance, such as the tension band 260. Consequently, a user may exercise different body parts with the same motion, simply by shifting their mental focus and concentrating on exercising those specific body parts. The user may employ shoulder straps 80 on the seatback 230 to help isolate abdominal and lower back muscles during workouts. Those skilled in the art will appreciate that the seat 218 may be fixed, while the connectors 242 and the foot support 220 are allowed to slide along the rails 226 without departing from the scope of the present invention.

The present invention is the only piece of exercise equipment known to applicant that allows a user to perform both cardiovascular (aerobic) and resistance exercise (anaerobic) of the abdominal muscles, the back muscles, biceps, buttocks, calves, chest, forearms, hamstrings, quadriceps, shoulders, and triceps all from the same position with the same basic motion.

Thus, the present invention has been described herein with reference to a particular embodiment for a particular application. Those having ordinary skill in the art and access to the present teachings will recognize additional modifications, applications, and embodiments within the scope thereof.

It is therefore intended by the appended claims to cover any and all such applications, modifications and embodiments within the scope of the present invention.

Accordingly,

What is claimed is:

1. An exercise machine comprising:

first means for providing a user option to apply positive resistance to a first leg and a second leg during pushing or pulling motions or to apply positive resistance to said first leg during pushing motions while providing positive resistance to said second leg during pulling motions;

second means for providing a user option to apply positive resistance to a first arm and a second arm during pulling motions or to apply positive resistance to said first arm and said second arm during pushing motions;

third means for facilitating abdominal crunches or back hyperextensions while exercising said legs and said arms via said first and second means; and wherein said exercise machine includes a seat that is vertically stationary relative to a surface upon which said exercise machine rests during operation of said exercise machine, said seat accommodating said user to facilitate operation of said first, second, and third means.

2. The exercise machine of claim 1 wherein said third means includes a seatback linked to said first and/or second means so that actuation of said first or second means causes actuation of said seatback, and wherein force applied via said first arm and/or second arm affects resistance felt by said first leg and/or said second leg and affects resistance to motion of said seatback, said seatback including means for securing an upper body to said seatback.

3. The exercise machine of claim 1 further including fourth means for varying resistance experienced by a user during select portions of a particular exercise motion relative to other portions of said exercise motion to facilitate targeting different muscle groups with different degrees of resistance.

4. The exercise machine of claim 2 wherein said third means further includes mechanical links between said first means, said second means, and said third means, said mechanical links interconnecting said first, second, and third means via swivel connectors.

5. The exercise machine of claim 4 further including fifth means employed by said first and second means for enabling said user to selectively adjust resistance levels felt by said arms and legs at portion of an exercise motion relative to another portion of said exercise motion to enable target loading of specific muscles or sections thereof.

6. A full-body exercise machine comprising:

a sitting support;

second means for providing positive resistance to motion of a user as said user moves one or more limbs into an extended position when sitting on said sitting support; and third means for providing positive resistance to motion of said one or more limbs as said user moves said one or more limbs into a compressed or curled position when sitting on said sitting support, said second means and said third means configured so that resistance affecting a first limb of said one or more limbs affects resistance applied to a second limb of said one or more limbs, said one or more limbs including one or more legs, and wherein said one or more limbs includes one or more arms, torso, and wherein said sitting support is vertically stationary during operation of said exercise machine.

7. A full-body exercise machine comprising:

a sitting support;

second means for providing positive resistance to motion of a user as said user moves one or more limbs into an extended position when sitting on said sitting support;

third means for providing positive resistance to motion of said one or more limbs as said user moves said one or more limbs into a compressed or curled position when sitting on said sitting support, said second means and said third means configured so that resistance affecting a first limb of said one or more limbs affects resistance applied to a second limb of said one or more limbs, said one or more limbs including one or more arms, one or more legs, and torso;

wherein said first means includes a stable frame;

wherein said sitting support is rigidly mounted on said frame;

wherein said frame includes a main support beam having a first end and a second end, said first end connected to a first stabilizer, said second end connected to a vertical support beam that is attached to a second stabilizer, said second end higher than said first end as determined by the height of said vertical support beam, which is adjustable; and wherein said second means includes a first tension band, a first end of said tension band connected to said frame, a second end of said tension band connected to a back support member, said back support member attached to a wheel resting on said frame so that when said user extends said one or more limbs to actuate said back support member, said wheel rolls along a main support beam of said frame, causing said tension band to extend.

8. The exercise machine of claim 7 wherein said second means includes a second tension band, a first end of said second tension band connected to said frame, a second end of said second tension band connected to said back support member so that when said user tucks said one or more limbs to actuate said back support member, said wheel rolls along a main support beam of said frame, causing said tension band to extend.

9. The exercise machine of claim 7 wherein said back support member is mechanically linked to an arm member at a first swivel connector at a pre-selected position along said arm member, and wherein said arm member is connected to said frame at a second swivel connector positioned on said arm member above said first swivel connector and in front of said stable sitting support so that said stable sitting support is positioned between said wheel and said second swivel connector on said frame.

10. The excercise device of claim 9 further including a first foot support and a second foot support mounted to a first foot member and a second foot member, respectively, said first and second foot members connected to said frame in front of said second swivel connector via a third swivel connector, thereby allowing said first and second foot supports to move in a pendular motion relative to said frame.

11. The exercise machine of claim 10 wherein said first foot member and said second foot member are connected to a first end of a first linking rod and to a first end of a second linking rod at fourth and fifth swivel connectors, respectively, which are positioned between said third swivel connector and said first and second foot supports on said first and second foot members, respectively.

12. The exercise machine of claim 11 wherein a second end of said first linking rod is connected to a sixth swivel connector or a seventh swivel connector positioned above or below said second swivel connector, respectively, on said arm member, and wherein a second end of said second linking rod is connected to an eighth swivel connector or a ninth swivel connector positioned below or above said second swivel connector, respectively, on said arm member.

13. A full-body exercise device comprising:

a frame having a seat mounted thereon;

arm and foot levers linked to said frame;

a seatback linked to said frame and said arm and foot levers so that actuation of said arm and foot levers causes actuation of said seatback and not said seat; and first means for selectively applying resistance to said arm and foot levers to adjust said full-body exercise machine for efficient aerobic or anaerobic exercise; wherein said seat is vertically stationary; and wherein said first means includes one or more tension bands or resistive swivel connectors connected between said frame and links, said links positioned between said seatback and said frame and further including means for selectively uncoupling said seatback with said arm and foot levers to prevent actuation of said seatback in response to actuation of said arm and foot levers, thereby stabilizing said seatback relative to said frame.

14. A full-body exercise device comprising:

a seatback;

one or more handles connected to one or more arm levers;

one or more foot supports connected to one or more foot levers;

a source of resistance;

means for linking force applied to said seatback to said one or more arm and foot levers and vice versa so that when said force is applied to said seatback, said one or more arm levers, and/or said one or more foot levers, said force works against said source of resistance, means for linking including linking rods, said linking rods readily connectable in various configurations including: a first configuration wherein pulling back on said one or more arm levers causes first and second foot levers to move backward together, and a second configuration wherein pulling back on said one or more arm levers causes said first foot lever to move back while said second foot lever moves forward; and wherein said seatback is movable in response to actuation of said one or more arm and foot levers by said user or by direct application of force to said seatback by said user.

15. The exercise device of claim 14 wherein pulling back on said one or more arm levers causes said seatback to move forward, and moving said seatback forward causes said one or more arm levers to move back, thereby enabling a rowing action and abdominal crunch action to occur simultaneously.

* * * * *